United States Patent [19]

Fournier et al.

[11] 4,161,985

[45] Jul. 24, 1979

[54] TOOL FOR REMOVING FLUIDS AND LOOSE MATERIAL FROM AN EARTH FORMATION

[75] Inventors: Onazip J. Fournier; Wayne F. Nelson, both of Wichita Falls, Tex.

[73] Assignee: The Dow Chemical Company, Midland, Mich.

[21] Appl. No.: 922,928

[22] Filed: Jul. 7, 1978 (Under 37 CFR 1.47)

[51] Int. Cl.[2] ..... E21B 37/00; E21B 41/00

[52] U.S. Cl. ..... 166/321; 137/527; 166/311

[58] Field of Search ..... 166/319, 299, 311, 333, 166/334, 321, 332; 137/625.44, 527, 467; 251/1 R, 106

[56] References Cited

U.S. PATENT DOCUMENTS

| | | | |
|---|---|---|---|
| 2,853,265 | 9/1958 | Clark, Jr. | 251/106 |
| 3,065,793 | 11/1962 | Page | 166/321 |
| 3,470,903 | 10/1969 | Scott | 137/467 |
| 3,779,263 | 12/1973 | Edwards et al. | 166/311 |
| 3,831,680 | 8/1974 | Edwards et al. | 166/311 |
| 3,964,305 | 6/1976 | Wray et al. | 166/321 |

*Primary Examiner*—James A. Leppink

*Attorney, Agent, or Firm*—V. Dean Clausen

[57] ABSTRACT

The tool of this invention is designed primarily for removing unconsolidated sand and other debris from the well casing perforations and adjacent earth formation in an oil or gas recovery operation. The basic tool includes an upper valve unit and lower valve unit, which are coupled together by a surge chamber. In a typical cleaning operation the tool is lowered into the well casing on a tubing string, which includes a by-pass and a retrievable packer. When the tool is at the desired position in the casing, the packer is set and the by-pass is closed. Fluid under pressure is pumped down the casing annulus to trip a mandrel in the lower valve and open a flapper disk. Bottom hole pressure causes fluid in the formation to fill the surge chamber and the sand and debris falls to the bottom of the hole. The packer is then unset and fluid pressure down the tubing string trips a piston in the upper valve and allows a stationary mandrel to open another flapper disk. The tubing string is then lowered to wash out the sand and debris in the hole by reverse circulation. After the formation has been cleaned the packer can be released and re-set to perform a further treatment, such as gravel packing, to achieve sand control.

5 Claims, 6 Drawing Figures

TOOL FOR REMOVING FLUIDS AND LOOSE MATERIAL FROM AN EARTH FORMATION

BACKGROUND OF THE INVENTION

The invention relates to a tool useful for removing fluids and loose material, such as unconsolidated sand, from an earth formation.

In the production of oil and gas various techniques are used to enhance recovery of the petroleum product from earth formations having low permeability. Hydraulic fracturing is an example of such a technique. This procedure involves pumping liquids under high pressure down the well casing and into the producing formation, which fractures the formation outwardly from the well casing. The fractures thus provide a larger surface area in the formation, to enable better drainage of the oil or gas into the well casing.

Following the fracturing operation, loose material, such as unconsolidated sand and other debris, remains in the void created in the formation and also in the perforations in the well casing and the cement jacket. This loose material must be flushed out of the formation and the perforations prior to further treatment, such as gravel packing, to achieve good sand control in the formation.

The tools now available for removing loose materials from a formation are not entirely satisfactory. For example, some of these tools include a rupture disk, so that there is not a full opening through the bore of the tool. In addition, once the disk is ruptured, during removal of material, the disk itself becomes a piece of debris which tends to restrict fluid flow through the tool bore. Another commercially available tool employs a ball valve which is difficult to open because of the high differential pressure between the fluids inside the tool bore and those in the annulus between the well casing and the tool.

SUMMARY OF THE INVENTION

The tool of this invention is used primarily to remove fluids and loose debris, such as unconsolidated sand, from an earth formation. The basic tool is made up of a first valve unit and a second valve unit which are connected together by a chamber section. The first valve unit includes a hollow piston positioned inside a sleeve member and the piston is slidable downwardly from a rest position to a latch position. Inside the piston is a hollow stationary mandrel.

In the first valve unit a flapper disk is hingably mounted on the inside of this sleeve member above the upper end of the mandrel. The upper end of the mandrel moves this disk from a closed position to an open position when the piston moves down to its latch position. An annulus is defined between the sleeve of the first valve unit and the lower end of the piston. Intake ports in this sleeve member communicate with the annulus.

The second valve unit has a hollow mandrel positioned inside the sleeve member itself, and this mandrel is slidable downwardly from a rest position to a latch position. The second valve unit also includes a flapper disk hingably mounted on the inside of the sleeve member. The disk is positioned below the lower end of the mandrel. The lower end of the mandrel thus moves this disk from closed to open position when the mandrel moves down to its latch position. An annulus is defined between the sleeve and the mandrel, and intake ports in this sleeve communicate with the annulus. The lower end of the sleeve for the first valve unit and the upper end of the sleeve for the second valve unit are coupled together by the chamber section.

In actual use tubing strings are fastened to the upper end of the first valve unit and the lower end of the second valve unit. The tubing strings are thus in direct communication with a central conduit which extends lengthwise through the entire tool. This arrangement permits fluids and loose material to flow from the earth formation through the tool and into the tubing strings.

DESCRIPTION OF A PREFERRED EMBODIMENT

Figure 1:
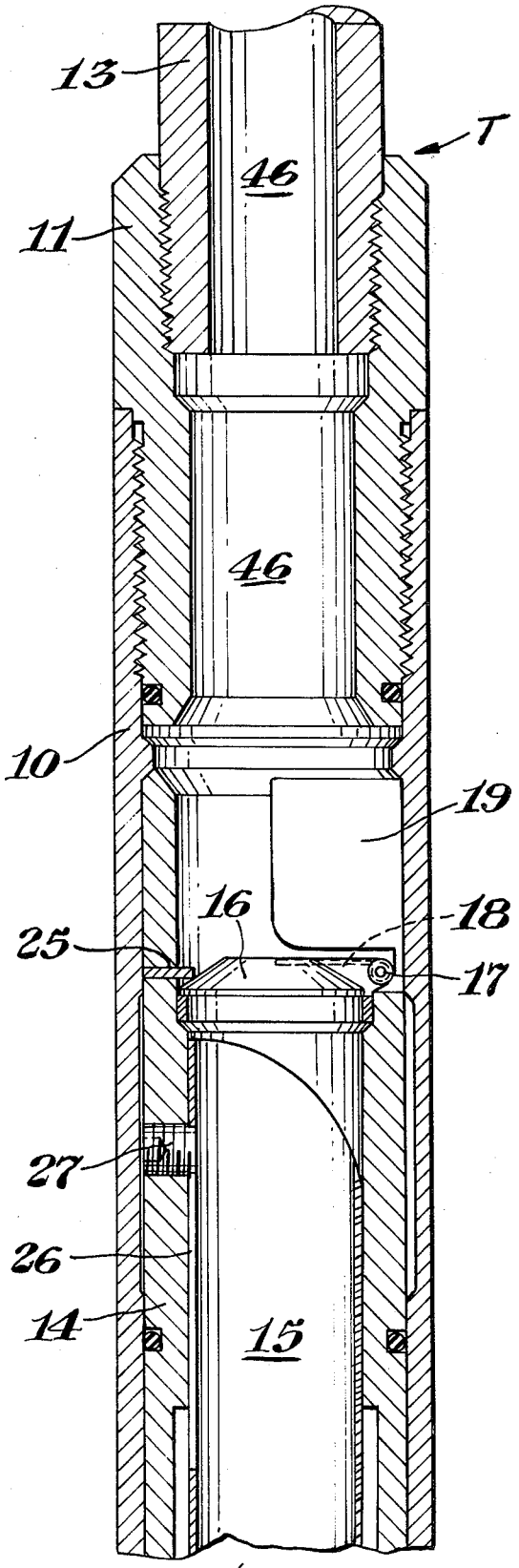
FIG. 1 is a partial view, in front elevation, and mostly in section, illustrating the upper part of the first valve unit in the present tool.

In the drawings the letter T generally indicates the tool of this invention. The basic tool is made up of a first valve unit and a second valve unit and a chamber section which connects the valve units together. The first valve unit includes a sleeve 10 which threads onto a top coupling 11 and a bottom coupling 12. A section of a tubing string 13 is connected into coupling 11 at the top.

Figure 1A:
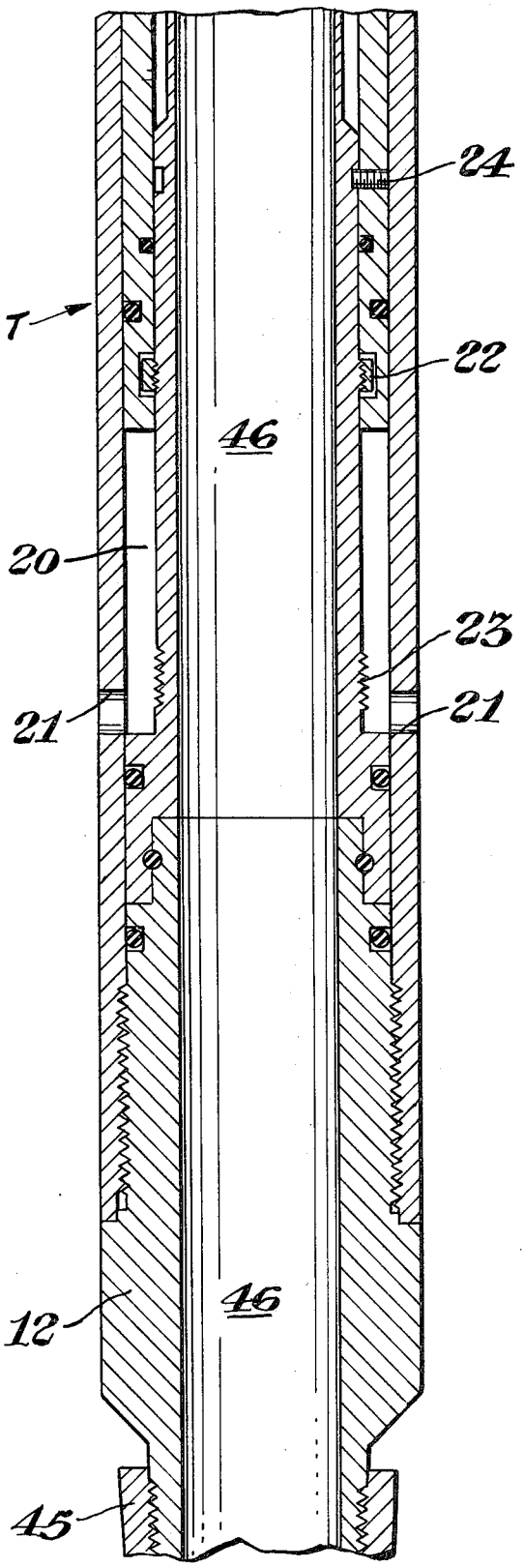
FIG. 1A is a partial front elevation view of the lower part of the first valve unit.

A hollow piston 14 is fitted inside of sleeve 10, with a slide fit which allows the piston to move downwardly from a rest position to a latch position. In FIGS. 1 and 1A the piston is shown in its rest position. A hollow mandrel 15 is fitted inside of the piston 14. Mandrel 15 remains stationary when the piston moves downwardly. A flapper disk 16 is hinged, on one side, to the inside wall surface of piston 14. Part of the hinge structure is a roll pin 17 and a spring 18.

In FIG. 1 the flapper disk 16 is shown in the closed position. In this position the disk lies above the curved upper end of mandrel 15. A cut-out surface 19 is milled into the inside wall of sleeve 10 above the disk 16. This cut-out surface allows the flapper disk to fully open during actual operation of the first valve unit. Near the lower end of mandrel 15 is an annulus 20, which is defined between sleeve 10 and the mandrel. Sleeve 10 includes intake ports 21, which communicate with annulus 20.

An expandable ring 22 is carried on mandrel 14 at the lower end of piston 14. Ring 22 has internal threads thereon which are designed to engage external threads 23 which are positioned on the mandrel below the ring. Engagement of the threads takes place as the ring 22 is moved downwardly by the sliding piston 14. Shear screws 24 are mounted on piston 14 near the lower end of the piston. These screws extend into recesses cut into mandrel 15 and they help to hold the piston 14 in its rest position. In actual practice three shear screws are used, but only one screw is illustrated in the drawings.

Figure 2:
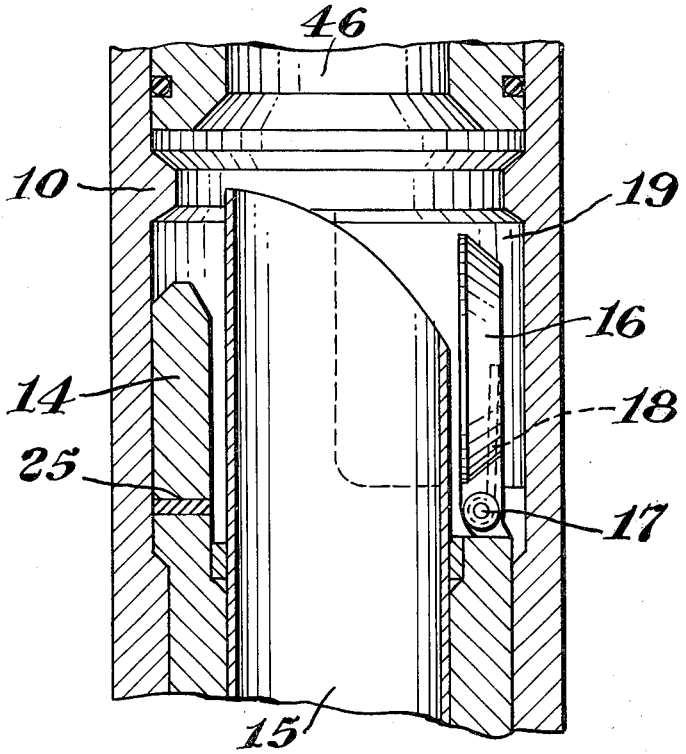
FIG. 2 is a detail view, in front elevation and in section, showing the upper end of a stationary mandrel in the first valve unit, and a flapper disk in the valve. In this view the flapper disk is in open position.

A single shear screw 25 is also mounted on piston 14 above the flapper disk 16. The free end of this screw wedges against the under surface of disk 16, to hold the disk in closed position prior to operation of the first valve unit. The upper end of mandrel 15 has a curved surface, as shown in FIGS. 1 and 2. This curved surface forms a distinct point along one side of the upper end of the mandrel. When the piston 14 moves downwardly the mandrel point first hits the bottom side of the disk 16 opposite to the hinge point. This arrangement prevents excessive stress which could damage the hinge structure. A vertical opening in the wall of mandrel 15 below the mandrel point provides a guide slot 26, as shown in FIG. 1. A screw plug 27 is mounted on piston 14, with the free end of the plug making a slide fit in slot 26. The plug 27 thus acts as a guide pin to insure that the mandrel 15 is properly positioned within the piston 14.

Figure 1B:
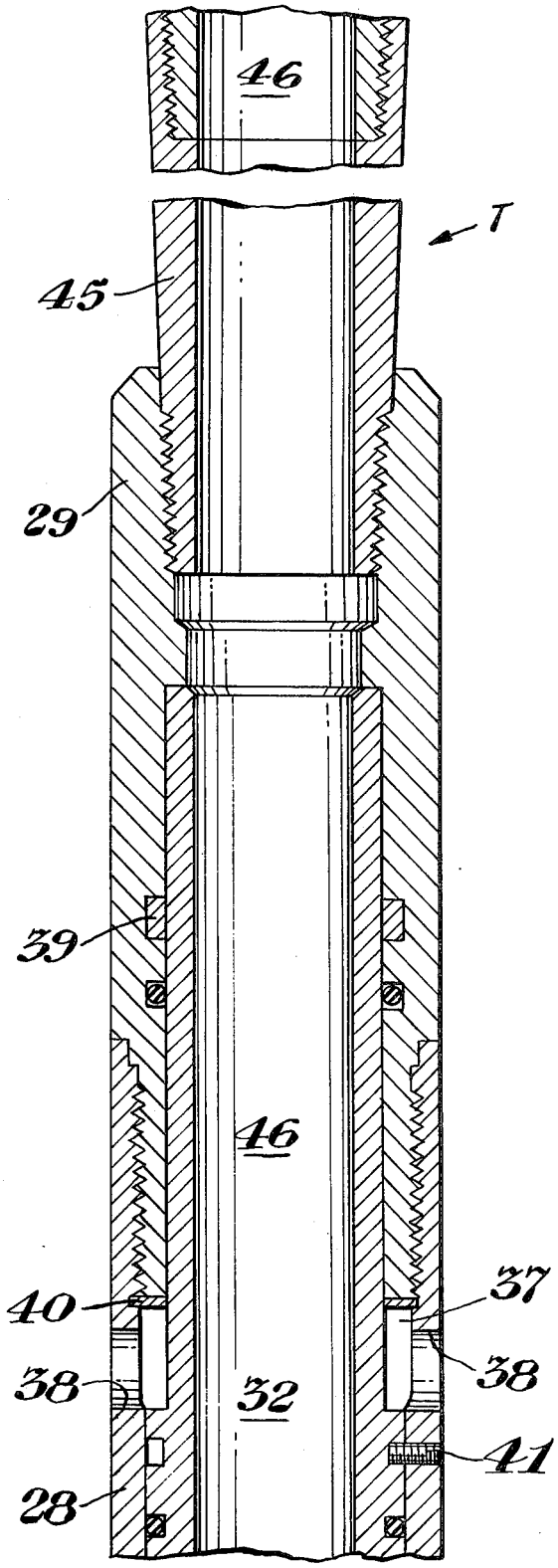
FIG. 1B is a partial front elevation view which shows the upper part of the second valve unit in the present tool.
Figure 1C:
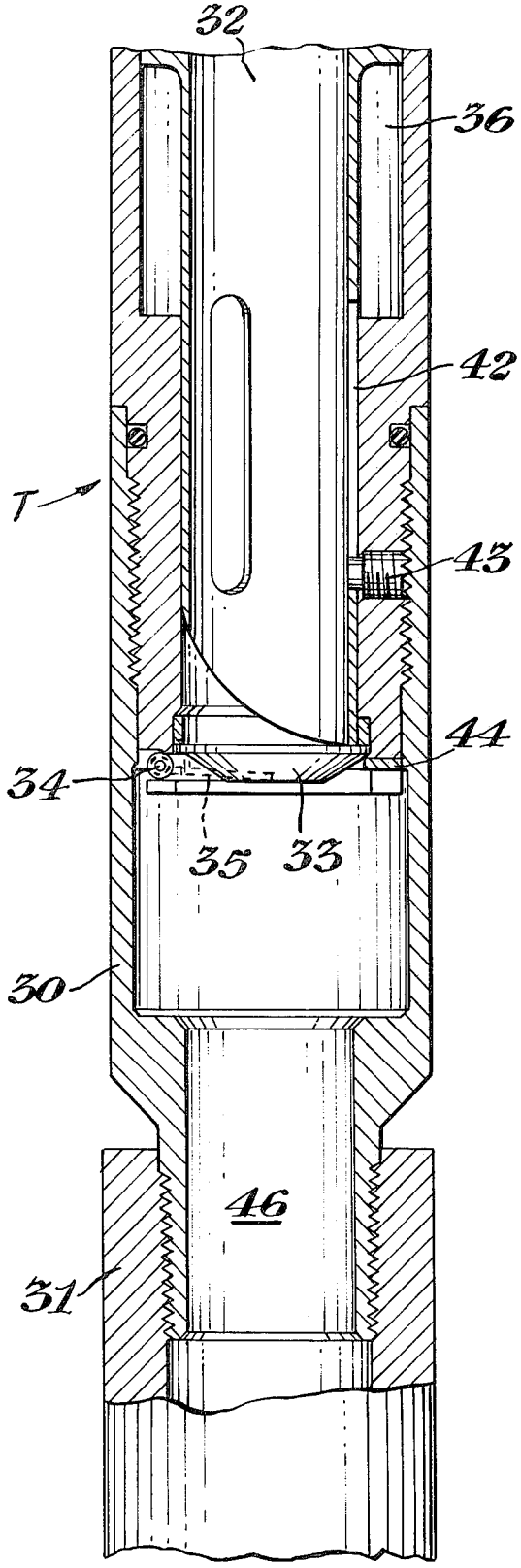
FIG. 1C is a partial front elevation view showing the lower part of the second valve unit.

The second valve unit, as shown in FIGS. 1A and 1B, includes a sleeve 28, which threads onto a top coupling 29 and a bottom coupling 30. A section of a tubing string 31 is connected onto coupling 30 at the bottom. A hollow mandrel 32 is fitted inside sleeve 28, with a slide fit which allows the mandrel to move downwardly from a rest position to a latch position. In FIGS. 1B and 1C the mandrel is shown in its rest position. A flapper disk 33 is hinged, on one side, to the inside wall surface of coupling 30. Part of the hinge structure is made up of a roll pin 34 and a spring 35.

In FIG. 1C the flapper disk 33 is in its closed position. In this position the flapper disk lies below the curved lower end of mandrel 32. Above the lower end of mandrel 32 is an annulus 36, which is defined between sleeve 28 and the mandrel itself. A second annulus 37 is also defined between sleeve 28 and mandrel 32 above the annulus 36. Sleeve 28 includes intake ports 38, which communicate with the annulus 37.

An expandable snap ring, indicated by numeral 39, is carried on mandrel 32 near the upper end of the mandrel. When this mandrel moves down to its latch position the ring 39 snaps outwardly and seats in a recess 40 above the intake ports 38. In actual use of this tool three shear screws, indicated by numeral 41, are mounted on sleeve 28 below the intake ports 38. These screws fit into recesses cut into mandrel 32 and they help to hold the mandrel in its rest position. Only one of the screws 41 is illustrated in the drawing.

Figure 3:
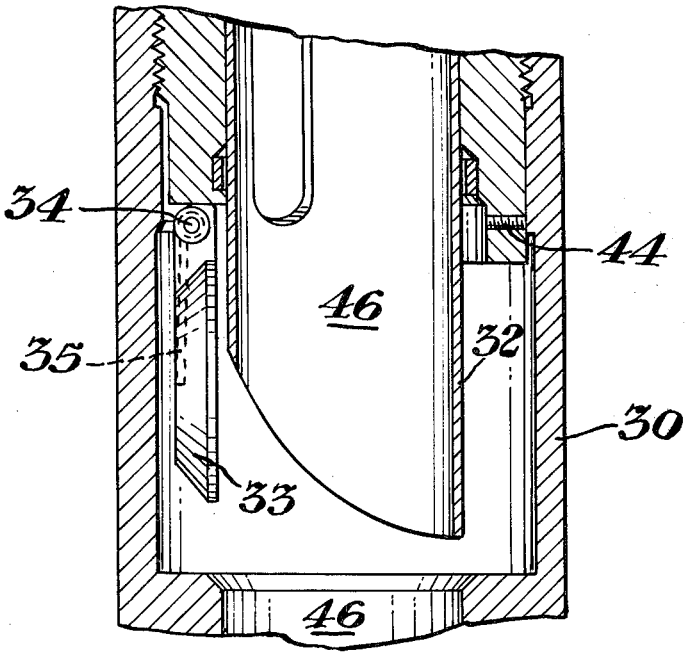
FIG. 3 is a detail view, in front elevation and in section, which shows the lower end of a movable mandrel in the second valve unit, and a flapper disk in the valve. In this view the flapper disk is shown in open position.

As shown in FIGS. 1C and 3, the lower end of mandrel 32 has a curved surface, which forms a distinct point on one side of the mandrel. When the mandrel moves downwardly this point first strikes the top side of the flapper disk 33 opposite to the hinge point of the disk. Mandrel 15 also has a guide slot 42 therein which lies above the lower end of the mandrel. A screw plug 43 is mounted on sleeve 28, such that the free end of the plug can ride in slot 42 and thus act as a guide to insure proper alignment of the mandrel inside sleeve 28.

A single shear screw 44 is also mounted on sleeve 28 below the flapper disk 33. The free end of screw 44 wedges against the under surface of disk 33 to hold the disk in its closed position prior to operation of the second valve unit. A pipe section, indicated by numeral 45, connects the coupling 12 of the first valve unit to the coupling 29 of the second valve unit. This pipe section provides a dry joint which functions as a surge chamber during operation of this tool. The actual length of the surge chamber is optional. Specifically, the length of this chamber depends primarily on the amount of debris to be cleaned out of the perforations and the formation. Numeral 46 indicates a central conduit which extends lengthwise through the entire tool T from the upper tubing string 13 to the lower tubing string 31.

OPERATION

The use of the present tool in a typical operation for flushing unconsolidated sand and other debris out of the casing perforations in the formation will now be described to illustrate the practice of the invention. The valve T is connected into the tubing string sections 13 and 31. On the tubing string 13 above the tool is a by-pass, such as a J-type by-pass. On the string 31 below the tube is a retrievable packer. The by-pass and the packer are not shown in the drawings.

The tubing string is lowered into the casing to the desired point above the casing perforations. As the tubing string is being lowered, part of the residual fluid in the casing bypasses the tool through the by-pass unit to achieve pressure equalization. Part of the residual fluid in the casing annulus also backflows through the intake ports 21 to exert upward pressure against piston 14. This upward pressure helps to prevent accidental downward movement of the piston.

When the tool is in the desired position in the well casing the packer is set, to seal off the casing annulus above the tool. The by-pass is also closed to seal off the tubing string above the tool. Fluid under pressure is then pumped down the casing annulus. This fluid enters the intake ports 38 of the second valve unit and forces the mandrel 32 downwardly to open flapper disk 33 (note FIG. 3). When the mandrel moves downwardly it shears off the screws 41 and the flapper disk 33 shears off the screw 44. At the same time the snap ring 39 moves downwardly and seats in recess 40 to latch the mandrel in place, so that it cannot move upwardly.

With the flapper disk 33 open the bottom hole fluid pressure causes an upward surge through the central conduit 46. The resulting surge carries the fluids up into the surge chamber 45 and the solids, such as the unconsolidated sand and other debris, drop into the "rathole" below the end of the well casing. Fluid under pressure is then pumped down the tubing string. This fluid forces piston 14 downwardly, causing the flapper disk 16 to hit the point on the stationary mandrel 15 and thereby open the flapper (note FIG. 2).

When the piston moves down it shears off screws 24 and the flapper disk shears off screw 25. Piston 14 also pushes the expandable ring 22 down along the mandrel until the ring engages the external threads 23. This sequence latches the piston so that it cannot move upwardly. The packer is then unset and the tubing string is lowered into the rathole. The fluid pressure down the tubing string through the tool T thus forces the sand and other debris up the casing annulus in a reverse circulation sequence.

Following the cleanout operation the tool T can either be pulled from the borehole or the packer can be reset in preparation for gravel packing, or some other treatment of the formation.

The invention claimed is:

1. A tool for removing fluids and loose material from an earth formation, the tool comprising:

a first valve unit, which includes a first sleeve member having an upper and lower end, a hollow piston positioned inside the sleeve member, and slidable downwardly from a rest position to a latch position, and having an upper and lower end, a first hollow mandrel positioned inside the piston, and having an upper and lower end, a first flapper disk hingably mounted on the inside of the first sleeve member above the upper end of the first mandrel;

the first disk being movable, by the upper end of the first mandrel, from a closed position to an open position, upon downward movement of the piston to the latch position;

a first annulus being defined between the first sleeve member and the lower end of the piston, the first sleeve member having first intake ports therein which communicate with the first annulus;

a second valve unit, which includes a second sleeve member having an upper and lower end, a second hollow mandrel positioned inside the second sleeve member, and slidable downwardly from a rest position to a latch position, and having an upper and lower end, a second flapper disk hingably mounted on the inside of the second sleeve member below the lower end of the second mandrel;

the second disk being movable, by the lower end of the second mandrel, from a closed position to an open position, upon downward movement of the second mandrel to the latch position;

a second annulus being defined between the second sleeve member and the second mandrel, the second sleeve member having second intake ports therein which communicate with the second annulus;

a surge chamber section which connects the lower end of the first sleeve member with the upper end of the second sleeve member;

the upper end of the first sleeve member being adapted for fastening into a first tubing string, and the lower end of the second sleeve member being adapted for fastening into a second tubing string; and a central conduit being defined lengthwise through the first valve unit, the chamber section, and the second valve unit, for enabling fluids and loose material to flow from the earth formation through the recited valve units and chamber section and into the tubing strings.

2. The tool of claim 1 which further includes:

a first elongate guide slot defining a vertical opening in the first mandrel below the upper end of said mandrel; and a first guide pin secured to the piston and having a free end which engages the first guide slot.

3. The tool of claim 1 which further includes:

a second elongate guide slot defining a vertical opening in the second mandrel above the lower end of said mandrel; and a second guide pin secured to the second sleeve member and having a free end which engages the second guide slot.

4. The tool of claim 1 which further includes a first expandable ring fitted onto the first mandrel and having internal threads thereon, said ring being adapted for moving downwardly on the first mandrel such that the internal threads can engage external threads positioned on the first mandrel near the lower end of the mandrel.

5. The tool of claim 1 which further includes a second expandable ring fitted onto the second mandrel, said ring being adapted to move downwardly with the second mandrel and seat in a groove defined between the second mandrel and the second sleeve member.

* * * * *